US008631606B2

(12) United States Patent
Hans

(10) Patent No.: US 8,631,606 B2
(45) **Date of Patent: *Jan. 21, 2014**

(54) AUTOMATICALLY SEALING TILTABLE DOOR PANEL SYSTEM

(71) Applicant: John B. Higman and Valorie J. Higman; Trustees of the Higman Family Trust u/d/t as amended and restated, Brea, CA (US)

(72) Inventor: Eric David Hans, Mission Viejo, CA (US)

(73) Assignee: John B. Higman and Valorie J. Higman, Brea, CA (US), Trustees of the Higman Family Trust u/d/t as amended and restated on Dec. 22, 2006

( * ) Notice: Subject to any disclaimer, the term of this patent is extended or adjusted under 35 U.S.C. 154(b) by 0 days.

This patent is subject to a terminal disclaimer.

(21) Appl. No.: 13/772,176

(22) Filed: Feb. 20, 2013

(65) Prior Publication Data

US 2013/0160369 A1 Jun. 27, 2013

Related U.S. Application Data

(63) Continuation of application No. 12/999,433, filed as application No. PCT/US2009/047540 on Jun. 16, 2009, now Pat. No. 8,381,445.

(60) Provisional application No. 61/073,320, filed on Jun. 17, 2008.

(51) Int. Cl.
*E06B 7/28* (2006.01)

(52) U.S. Cl.
USPC ..... 49/316

(58) Field of Classification Search
USPC ..... 49/316, 317, 318, 319, 320, 321, 209, 49/210, 221, 222, 223, 224
See application file for complete search history.

(56) References Cited

U.S. PATENT DOCUMENTS

| | | | |
|---|---|---|---|
| 2,248,719 | A | 7/1941 | Owen |
| 2,766,860 | A | 10/1956 | Travis |
| 2,971,228 | A | 2/1961 | Szabo |
| 3,072,975 | A | 1/1963 | Burmeister |
| 3,225,393 | A | 12/1965 | Coller |
| 3,295,257 | A | 1/1967 | Jackson |
| 3,400,504 | A | 9/1968 | Neisewander |

(Continued)

OTHER PUBLICATIONS

International Search Report and Written Opinion in PCT Application No. PCT/US2009/047540 dated Jul. 31, 2009 in 12 pages.

*Primary Examiner* — Jerry Redman
(74) *Attorney, Agent, or Firm* — Knobbe, Martens, Olson & Bear, LLP

(57) ABSTRACT

A sliding door system can include a tiltable sealing mechanism such that, when a door panel is slid to a closed configuration, one or more seal elements form a seal between the door panel and its surroundings at the top, bottom, and/or sides of the door to reduce or prevent infiltration or communication of gases or liquids such as air or water. Manual or motor driven movement of the panel can move an actuation mechanism to extend the seals around the door. The sealing member can include weather stripping, brush or another seal element for sealing contact with a header, floor, door, frame, or other surface. Multiple door panels can be arranged to form a door panel system.

20 Claims, 13 Drawing Sheets

(56) References Cited

U.S. PATENT DOCUMENTS

| | | | | | |
|---|---|---|---|---|---|
| 3,660,936 | A | | 5/1972 | Bryson | |
| 4,372,084 | A | | 2/1983 | Janke | |
| 4,454,690 | A | | 6/1984 | Dixon | |
| 4,562,667 | A | * | 1/1986 | von Resch | 49/176 |
| 4,611,436 | A | | 9/1986 | Williams | |
| 4,644,690 | A | | 2/1987 | Caimi | |
| 4,656,779 | A | | 4/1987 | Fedeli | |
| 4,669,219 | A | * | 6/1987 | Tomida | 49/130 |
| 4,688,352 | A | | 8/1987 | Kinoshita | |
| 4,794,730 | A | * | 1/1989 | Fischbach | 49/130 |
| 4,802,307 | A | * | 2/1989 | Schmidt | 49/219 |
| 4,805,345 | A | | 2/1989 | Ohi | |
| 4,829,710 | A | * | 5/1989 | Schmidt | 49/125 |
| 4,845,891 | A | * | 7/1989 | Fischbach | 49/219 |
| 5,115,596 | A | | 5/1992 | Fevold et al. | |
| 5,301,468 | A | | 4/1994 | Kamezaki | |
| 5,339,881 | A | | 8/1994 | Owens | |
| 5,467,559 | A | | 11/1995 | Owens | |
| 5,471,791 | A | | 12/1995 | Keller | |
| 5,481,834 | A | | 1/1996 | Kowalczyk et al. | |
| 5,839,228 | A | * | 11/1998 | Duffy | 49/223 |
| 6,082,047 | A | | 7/2000 | Comaglio et al. | |
| 6,336,246 | B1 | * | 1/2002 | Giovannetti | 16/87 R |
| 6,497,072 | B2 | | 12/2002 | Fries | |
| 6,581,332 | B1 | | 6/2003 | Kim | |
| 6,871,448 | B1 | | 3/2005 | Kline | |
| 7,124,538 | B1 | | 10/2006 | Kline | |
| 7,552,561 | B2 | * | 6/2009 | Schneckenleitner | 49/362 |
| 7,627,987 | B2 | | 12/2009 | Thielmann et al. | |
| 7,685,774 | B2 | | 3/2010 | Thielmann | |
| 7,685,775 | B2 | | 3/2010 | Speyer et al. | |
| 7,685,776 | B2 | | 3/2010 | Speyer et al. | |
| 8,033,068 | B2 | | 10/2011 | Luttmann et al. | |
| 8,109,037 | B2 | | 2/2012 | Speyer et al. | |
| 8,381,445 | B2 | * | 2/2013 | Hans | 49/316 |
| 2008/0202030 | A1 | * | 8/2008 | Heiniger et al. | 49/224 |
| 2008/0209827 | A1 | | 9/2008 | Webb | |
| 2009/0077895 | A1 | | 3/2009 | Tshai | |
| 2011/0107674 | A1 | | 5/2011 | Sauter | |
| 2011/0126471 | A1 | | 6/2011 | Hans | |

* cited by examiner

AUTOMATICALLY SEALING TILTABLE DOOR PANEL SYSTEM

CROSS-REFERENCE TO RELATED APPLICATIONS

This application is a continuation of U.S. application Ser. No. 12/999,433, filed on Dec. 16, 2010, which is a U.S. National Phase of International Application No. PCT/US2009/047540, filed on Jun. 16, 2009 and published in English on Dec. 23, 2009, which claims the benefit of priority to U.S. Provisional Application No. 61/073,320, filed Jun. 17, 2008, each of which is incorporated in its entirety by reference herein. Any and all priority claims identified in the Application Data Sheet, or any correction thereto, are hereby incorporated by reference under 37 CFR 1.57.

BACKGROUND

1. Field of the Invention

This application relates to door seals and, more specifically, to a sliding door system including a sealing mechanism for a sliding door panel that is actuated when the door is in a predetermined position.

2. Description of the Related Art

Various sliding doors and door systems have long been a desirable option for providing access to residences, businesses and other structures as they can provide a large opening without requiring a large swing area, as might be required with a swinging door of the same size. Moreover, in some door systems, two or more sliding door panels have been arranged, typically sliding on parallel tracks, to form a "multislide" door system that can span a relatively large opening. The individual door panels of a multislide door system can include relatively large transparent or translucent windowpanes to provide access to a panoramic view or a large amount or light even when the door system is closed. Substantially all of the door panels of certain multislide systems can be retracted into a pocket in an adjacent wall, such that when the door system is open, an indoor/outdoor building space is created.

In some multislide door systems, a lower track, on which one or more door panels slides, is recessed into the floor such that when the door system is open, there is no threshold or obstacle over which to step (or stub one's toe). Additionally, the recessed track creates a relatively seamless visual transition between indoor and outdoor space.

While sliding doors and multislide systems can be desirable for the reasons noted above, some sliding door systems are difficult to seal. Many sliding door systems include some type of weather stripping or a brush along a lower edge of each door panel to form a seal with the floor surface. However, in order to effectively seal, these types of weather stripping or brushes must slide along the floor while the door system is being opened or closed. Accordingly, the weather stripping can wear rather quickly until it loses effectiveness at forming a seal. If the unit is adjusted downward in order to close the gap too much, the added friction will not allow the panel to slide freely. Many attempts to just add brushes to reduce the friction will allow water and air infiltration. Moreover many of these types of systems do not have a way to reduce air infiltration at the header, typically they have some type of guide block in the header profile that guides the panel as it is sliding and only have some type of brush that glides against the panel. Thus, many of these systems cannot be easily reconfigured to compensate for the wearing of the weather stripping, or the gradual shifting of a door frame.

Some systems include relatively large lever handles on each door panel to allow a user to raise and lower the panel slightly (such as raised for sliding, lowered for sealing). Moreover, most of these systems cannot be adjusted via the wheels to compensate for a non-level floor. This means that once the panel is lowered to the sealing position the panel resting on the non-level floor will not be level. On larger panels this becomes an issue due to the fact that the leading edge will not rest plumb against the jamb. This may prevent the panel interlockers from sealing, thereby allowing air infiltration. One trend in the sliding door industry is to automate these systems so that a motor pulls and/or pushes all the panels open at the touch of a button. Attempts to combine automated open and closure systems with a system that lowers to seal is very cost prohibitive. In certain instances the large handle needed to leverage the heavy panels into the up and down position that are mounted on each panel hinders the panel stack (e.g., many panels going in one direction) from stacking flush to each other in the open position. In some instances large handles may prevent the panels from going all the way into the pocket.

SUMMARY OF THE INVENTION

The present application discloses various embodiments of a sliding door system and a door panel for a sliding door system that offer certain advantages in view of the above-noted shortcomings of existing doors. The details of various embodiments are set forth in the accompanying drawings and the description below. Other features and advantages will be apparent from the description and drawings, and from the claims.

In certain embodiments, the door systems and door panels disclosed herein can include a movable sealing member that is moveable to a first, extended position to form a seal with a floor surface at a desired position of a door panel (such as a closed position). The sealing member can move to a second, retracted position at other positions of the door panel. In certain embodiments, the sealing system forms a seal with the top surface of the door panel at a closed position. In certain embodiments, a sealing system forms seals with one or two sides of the door panel and an adjacent door panel or wall or other structure. In certain embodiments the sealing system uses elements at the top of a door to seal the top of the door and/or elements at the bottom of a door to seal the bottom of the door. In certain embodiments the sealing system uses elements at the top, bottom and/or one or more sides of the door to seal respective sections In certain embodiments, a sliding door system comprises a door frame, and a door panel. In one embodiment, a door frame comprises a header and a lower track. In one embodiment, the header defines an upper edge of the door frame and has an upper track. The lower track defines a lower edge of the door frame. In one embodiment, the door panel is slideably mounted on the upper track and the lower track. In one embodiment, the door panel comprises a sealing member and an actuator. In one embodiment, the sealing member is movably mounted at a lower edge of the door panel. The sealing member is movable between a first position in which the sealing member is extended downward with respect to the door panel, and a second position in which the sealing member is retracted with respect to the door panel. The actuator is configured to advance the sealing member into the first position when the door panel reaches a predetermined actuation location on the upper track and/or the lower track.

In other embodiments, a door panel comprises a first door stile, a second door stile, an upper rail, a lower rail, an upper sliding mechanism, and a sealing mechanism. The first door stile defines a first side edge. The second door stile defines a second side edge opposite the first side edge. The upper rail defines an upper edge. The lower rail defines a lower edge. The central area is bounded by the first door stile, the second door stile, the upper rail, and the lower rail. The upper sliding mechanism is configured to slideably mount the door panel to a header of a door frame. The sealing mechanism comprises a sealing member and an actuator. The sealing member is positioned on the lower rail and is movable between a first position in which the sealing member is extended downward with respect to the lower rail, and a second position in which the sealing member is retracted with respect to the lower rail. The actuator is configured to move the sealing member between the first position and the second position.

In various embodiments, a sealable sliding door system can include a header, a track and a door panel. In one embodiment, the track is parallel to the header. In one embodiment, the door panel is slideably moveable along the track and the header. In one embodiment, the door panel includes a first side edge, a second side edge, an upper edge and a lower edge. In one embodiment the door panel includes a sealing member that is movably actuatable with respect to a sealing edge of the door panel. In one embodiment, the sealing member is movably actuatable between a retracted position and a sealed position. In one embodiment, the retracted position configured for slideable movement of the door panel along the track. In one embodiment, the sealed position closing a distance between the sealing edge of the door panel and a corresponding adjacent surface. In one embodiment the door panel includes an actuator configured to advance the sealing member into the sealed position when the door panel reaches a predetermined location corresponding to a closed configuration.

In one embodiment, the door panel includes a first stile corresponding to the first side edge of the door panel. In one embodiment, the door panel includes a second stile corresponding to the second side edge of the door panel. In one embodiment, the door panel includes an upper rail corresponding to the upper edge of the door panel. In one embodiment, the door panel includes a lower rail corresponding to the lower edge of the door panel. In one embodiment, the door panel includes a central area bounded by the first door stile, the second door stile, the upper rail, and the lower rail. In one embodiment, movement of the door panel with respect to the track defines a sliding axis of the door panel, wherein the door panel has a length along the sliding axis, and wherein the sealing member has a length that is substantially equal to the length of the door panel. In one embodiment, the sealing member is connected to one or more seal actuation mechanisms comprising at least a three point linkage. In one embodiment, the sealing member is connected to one or more seal actuation mechanisms comprising a scissor mechanism. In one embodiment, the sealing edge corresponds to the lower edge of the door panel and the corresponding adjacent surface is a floor surface. In one embodiment, the floor surface is substantially non-parallel with the lower edge of the door panel.

In one embodiment, sealable sliding door system includes a second sealing edge corresponding to an upper edge of the door panel, where the second sealing edge is configured to reduce a second distance between the upper edge of the door panel and the header when the door panel reaches the predetermined location corresponding to the closed configuration. In one embodiment, the sealable sliding door includes at least one actuation surface and at least one corresponding door tilting interface configured to tilt the door panel when the door panel reaches a predetermined location corresponding to the closed configuration. In one embodiment, movement of the door panel in a tilt direction reduces the second distance. In one embodiment, the sealable sliding door system also includes a seal element disposed between the upper edge of the door panel and the header. In one embodiment, the sealing member comprises a sealing bar formed by an extrusion process, and a sealing strip disposed on the sealing bar. In one embodiment, the door panel also includes a biasing member configured to bias the sealing member into the retracted position. In one embodiment, the sealable sliding door system includes a second door panel slideably moveable along a second track and the header. In one embodiment, the sealable sliding door system includes a motor configured to slide the door panel along the track to selectively open and close the door panel. In one embodiment, the actuator comprises an actuation mechanism with a substantially horizontal transfer member slideably disposed and moveable within or near a lower edge of the door panel. In one embodiment, the actuation mechanism comprises at least one roller mechanism configured to roll on an actuation surface on the header.

In various embodiments, a door panel includes a first door stile defining a first side edge, a second door stile defining a second side edge opposite the first side edge, an upper rail defining an upper edge, and a lower rail defining a lower edge. In one embodiment, the door panel includes a central area bounded by the first door stile, the second door stile, the upper rail, and the lower rail. In one embodiment, the door panel includes an upper sliding mechanism configured to slideably mount the door panel to a header of a door frame. In one embodiment, the door panel includes a sealing mechanism with a sealing member positioned on the lower rail and movable between a first position and a second position. In one embodiment, the first position has the sealing member extended downward with respect to the lower rail. In one embodiment, the second position has the sealing member retracted with respect to the lower rail. In one embodiment, the door panel includes an actuator configured to move the sealing member between the first position and the second position.

In one embodiment, the actuator includes an actuation mechanism and a transfer member coupling the actuation mechanism to the sealing member. In one embodiment, the actuation mechanism includes a roller mechanism configured to roll on an actuation surface on the door frame. In one embodiment, the roller mechanism is rotatably mounted to the upper rail and configured to roll on an actuation surface on the header of the door frame. In one embodiment, the transfer member extends through one of the first door stile and the second door stile. In one embodiment, the actuator includes a first roller mechanism mounted to the upper rail and configured to roll on an actuation surface on the header of the door frame. In one embodiment, the actuator includes a second roller mechanism mounted to the upper rail and configured to roll on an actuation surface on the header of the door frame. In one embodiment, the actuator includes a first transfer member extending through the first door stile and coupling the first roller mechanism to the sealing member. In one embodiment, the actuator includes a second transfer member extending through the second door stile and coupling the second roller mechanism to the sealing member.

BRIEF DESCRIPTION OF THE DRAWINGS

These and other aspects of embodiments of the present invention will now be described in detail with reference to the following drawings.

Figure 1:
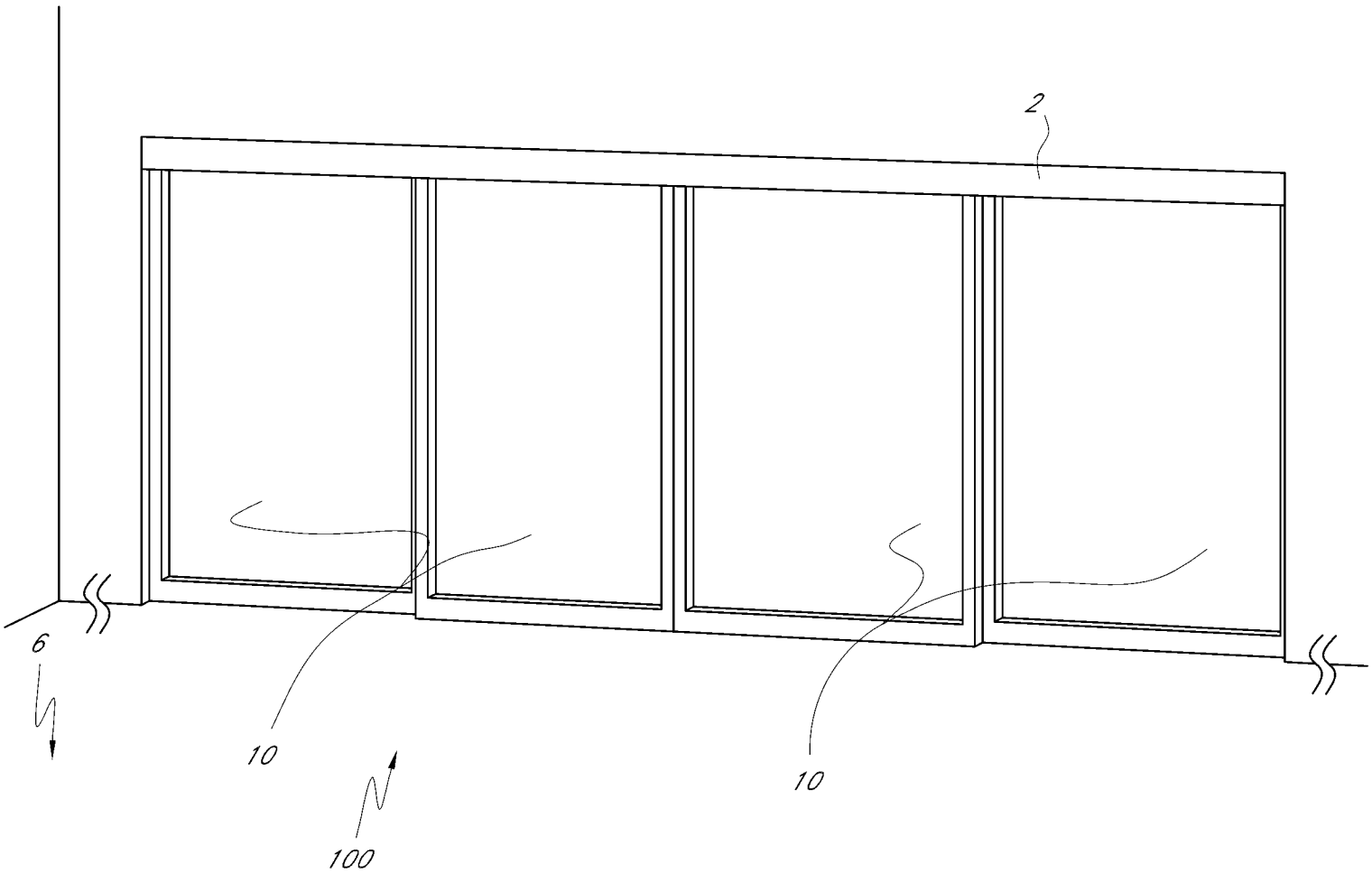
FIG. 1 is a schematic front perspective view of a door panel system including four door panels according to one embodiment of the present invention.

Like reference symbols in the various drawings indicate like elements. Throughout the figures, the same reference numerals and characters, unless otherwise stated, are used to denote like features, elements, components or portions of the illustrated embodiments. Moreover, while embodiments of the subject invention will now be described in detail with reference to the figures, it is done so in connection with the illustrative embodiments. It is intended that changes and modifications can be made to the described embodiments without departing from the true scope and spirit of the subject invention as defined by the appended claims.

DETAILED DESCRIPTION

In various embodiments, one or more embodiments of one or more door panels 10 as described herein can be used or can be integrated to form a door panel system 11. In various embodiments, any number of embodiments of one or more door panels 10 can be used to form a door panel system 11. In various embodiments, additional door panels can be denoted with a prime symbol, such as a first door panel 10, a second door panel 10', a third door panel 10", etc. In one embodiment, FIG. 1 illustrates a door panel system 11 having four door panels 10, arranged with two pairs positioned on each side to meet in the middle, in a closed configuration 100. A reference arrow numbered 101 illustrates sliding motion along a track 4, 8 in the direction of the closed configuration 100. In one embodiment, FIG. 1 illustrates a door panel system 11 having four door panels 10, arranged with two pairs positioned on each side to meet in the middle, in a closed configuration 100. In one embodiment, the closed configuration 100 is a sealed configuration. In one embodiment, the closed configuration 100 comprises having a sealing member 40 in the door panel 10 actuated in an extended configuration 110. In one embodiment, the door panel 10 is configured to open and close between an interior 120 and an exterior 122. In one embodiment, the interior 120 is the inside of a building, house, room, or structure. In one embodiment, the exterior 122 is the outside of a building, house, room, or structure. In various embodiments, although the term interior 120 or exterior 122 is used, the names are being used in reference to a side of embodiments of the door panel 10 and can simply refer to a side of a wall or side of the door panel 10 whether one side is in or out of a structure or wall. In various embodiments the interior 120 and/or exterior 122 can be any combination of inside, outside, both inside or both outside of a structure, wall, etc.

Figure 2:
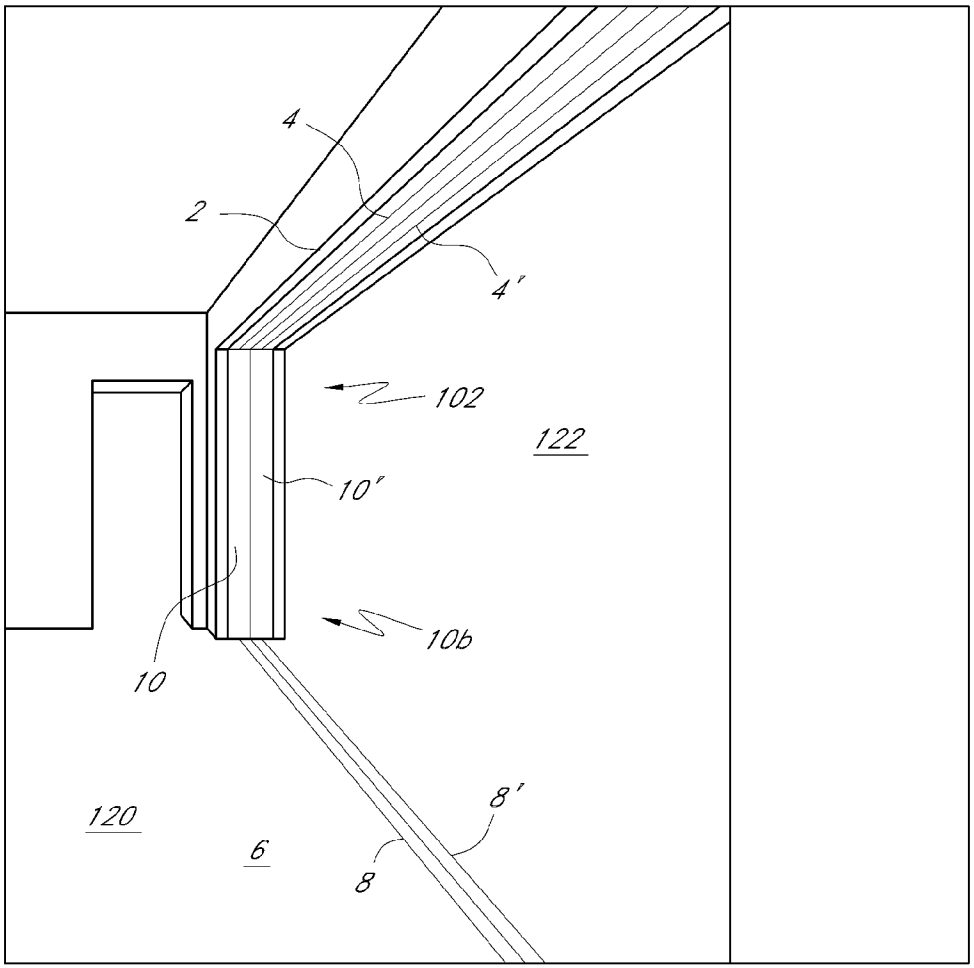
FIG. 2 is a schematic side perspective view of tracks for the door panel system of FIG. 1.

In one embodiment, the door panel system 11 can have an open configuration 102, such as is illustrated at FIG. 2, which illustrates the door panel system 11 of FIG. 1 in an open configuration 102. In one embodiment, the open configuration 102 comprises a door panel 10 disposed in a pocket 3, or in a pocket configuration 106. In one embodiment, the open configuration 102 comprises a door panel 10 slideably disposed on one or more tracks 4, 8 between the pocket configuration 106 and the closed configuration 100.

In one embodiment, each door panel 10 is slideably disposed on a track segment 8. The door panels 10 in each pair run on parallel tracks 4, 4', 8, 8'. It is contemplated that multiple door panels 10 having a sealing system can be arranged (for example, including two, three, four, five, six, or more door panels 10) to form various sliding door systems 11. While FIGS. 1 and 2 do not necessarily illustrate all the detailed features of the automatically sealing panels discussed herein, it is contemplated that at least some of the features of the various embodiments of an automatically sealing door panel 10 can be integrated in one or more door panels of a door panel system 11.

With reference to FIGS. 3-7, in one embodiment, a door panel 10 having a sealing system is disclosed. The door panel 10 can be configured to be slideably mounted to a door frame 1 having a header 2 and an upper track 4. In one embodiment, one or more door panels 10 can be stored in a pocket 3 to the side of the door frame 1 or an upper track 4 or a lower track 8. For example, in some embodiments, the door panel 10 can include one or more upper roller mechanisms 30 configured to ride in the upper track 4 to guide the door panel 10 along the upper track 4. In one embodiment, the door panel 10 has adjustable rollers. In one embodiment, the door panel 10 has weather stripping. In one embodiment, both adjustable rollers and weather stripping are used together, and as the rollers are adjusted the weather stripping may or may not come into contact with the threshold or the ground.

In one embodiment, the door panel 10 can be configured to be slideably disposed on a lower track 8. In various embodiments, the lower track 8 can be recessed below a floor surface 6, even with a floor surface 6, or raised above a floor surface 6. In the one embodiment, the door panel 10 can further be configured to be slideably disposed on a lower track 8 recessed into a floor surface 6. For example, in some embodiments, the door panel 10 can include one or more lower roller mechanisms 32 configured to ride on the lower track 8. In some embodiments, the door panel 10 can be configured to run on a lower track 8 that is not recessed.

Various embodiments of the header 2, upper track 4, floor surface 6, and recessed lower track 8 are schematically illustrated in at least FIGS. 3-7, but the actual configuration may vary depending on the particular door installation. For example, it can be desirable, in certain embodiments, that a majority of the weight of the door panel 10 is suspended from the upper track 4 in the header 2. In other embodiments, it can be desirable that a majority of the weight of the door panel 10 rests on the lower track 8.

In one embodiment, the door panel 10 can be formed of a framed construction comprising a first stile 12 defining a first side edge of the door panel, a second stile 14 defining a second side edge of the door panel, a lower rail 16 defining a lower edge of the door panel 10, and an upper rail 18 defining an upper edge of the door panel 10. The stiles and rails 12, 14, 16, 18 bound a central area 20 that in various embodiments can include a transparent or translucent pane of glass or other material. While one embodiment may include a large transparent central area, in some embodiments, the door panel 10 can be of substantially solid construction, such as a wood door panel, or have an opaque or non-transparent central area 20. It is contemplated that a sealing system as described herein can be applied to an embodiment of door panel 10 with a substantially solid or non-transparent central area, and reference to stiles and rails herein refers to the vertical and horizontal outer sections of the door panel 10.

In various embodiments, the stiles 12, 14 and the rails 16, 18 can comprise a rigid material such as a wood, metal, plastic or polymer, composite, or other suitable material construction. In some embodiments, the stiles 12, 14 and the rails 16, 18 comprise a hardwood. In some embodiments, the stiles 12, 14 and the rails 16, 18 comprise aluminum. In some embodiments, the stiles 12, 14 and the rails 16, 18 comprise a wood reinforced with at least a metallic strip. Where the stiles 12, 14 and the rails 16, 18 are comprised of a metal, in some embodiments, they can be formed by extrusion. In various embodiments, any combination of materials can be used.

In one embodiment, the door panel 10 can also include latch and/or lock hardware disposed in one of the stiles 12, 14 or the rails 16, 18. The latch or lock hardware (not illustrated) can be used to selectively secure the door panel 10 in a fixed position with respect to another door panel 10 in a door panel system 11, or to secure the door panel 10 to a door frame 1.

In one embodiment, the door panel 10 can further comprise a sealing system. In one embodiment, the sealing system comprises a sealing member 40 and an actuator 41. In various embodiments the sealing system sealing member 40 is configured to seal the bottom, side, and/or top of a door panel 10. In one embodiment, the sealing system comprises a sealing member 40 configured to seal the side or top of a door panel 10. Although the some of the described embodiments focus on a sealing member 40 configured to seal the bottom of a door panel 10, the sealing member 40 embodiments are not limited to such. In one embodiment, the sealing member 40 has an extended configuration 110 corresponding to a closed configuration 100. In one embodiment, the sealing member 40 has a retracted configuration 112 corresponding to an unsealed, less sealed configuration, or open configuration 102. In some embodiments, the sealing member 40 can comprise an elongate member that has a length substantially equal to a length of door panel 10 with respect to an axis defined by the sliding of the door panel 10 on the upper track 4 and the lower track 6 and a width substantially equal to a width of the door panel 10. The sealing member 40 can be formed of a substantially rigid material, such as a metal, wood, plastic or polymer, composite, or other material. In some embodiments, the sealing member 40 can be formed of an extruded aluminum material. As further discussed below, the sealing member 40 can be movable with respect to a lower edge of the door panel 10 between a first position in which the sealing member 40 is in a extended downward from the lower edge of the door panel 10 and a second position in which the sealing member is retracted with respect to the door panel. In one embodiment, the lower rail 16 can have a recess in which at least a portion of the sealing member 40 is disposed when it is in the retracted position 112.

Figures 3, 4, 5:
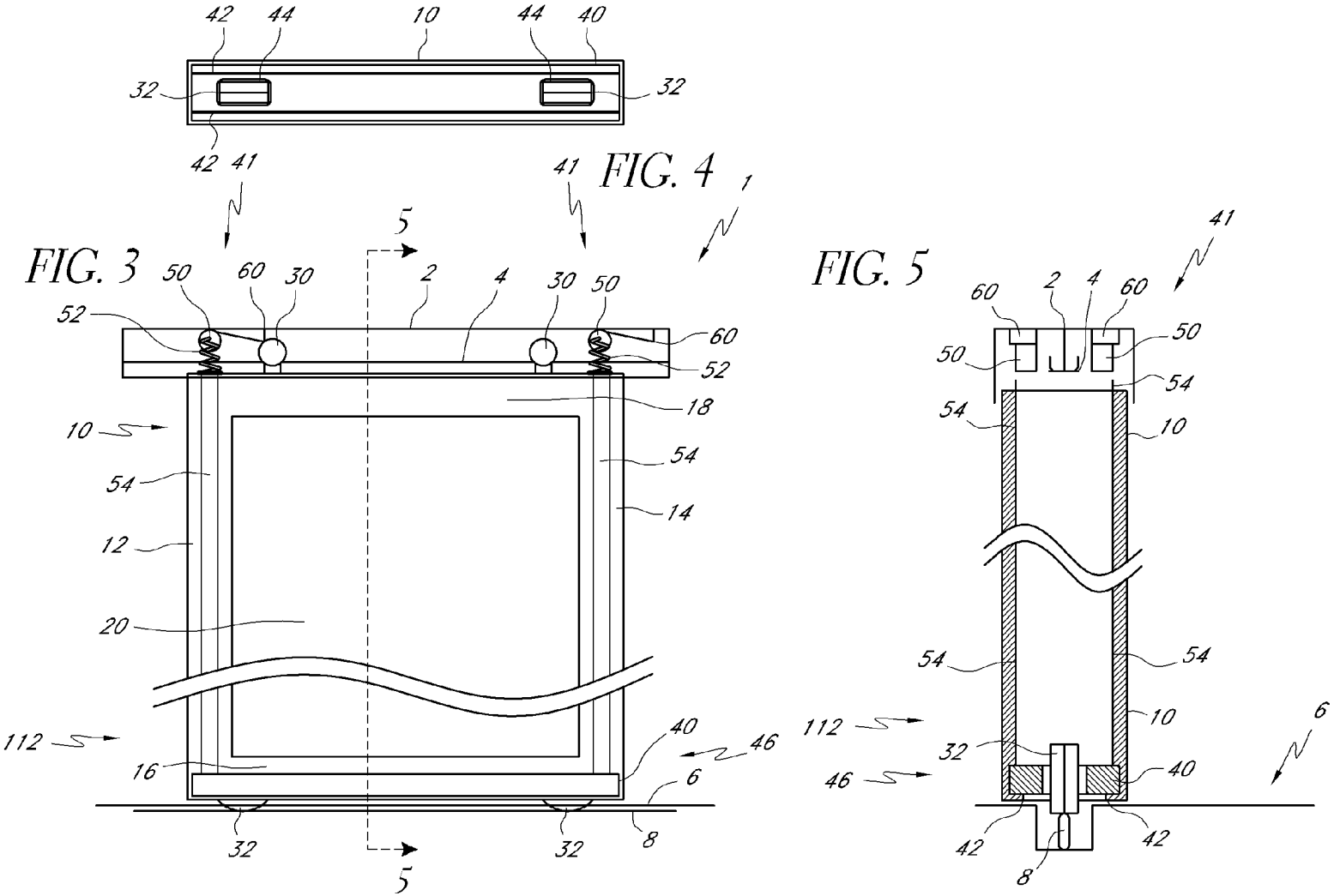
FIG. 3 is a schematic front elevational view of one embodiment of door panel having a movable sealing member in a retracted configuration.
FIG. 4 is a schematic bottom view of the door panel of FIG. 3.
FIG. 5 is schematic side sectional view of the door panel of FIG. 3.
Figure 7:
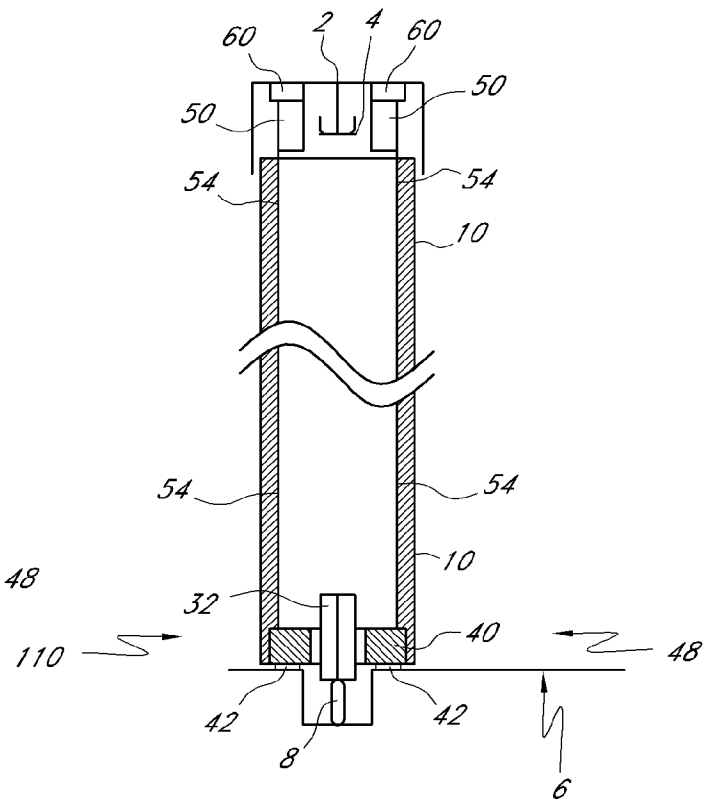
FIG. 7 is a schematic side sectional view of the door panel of FIG. 6.
Figure 6:
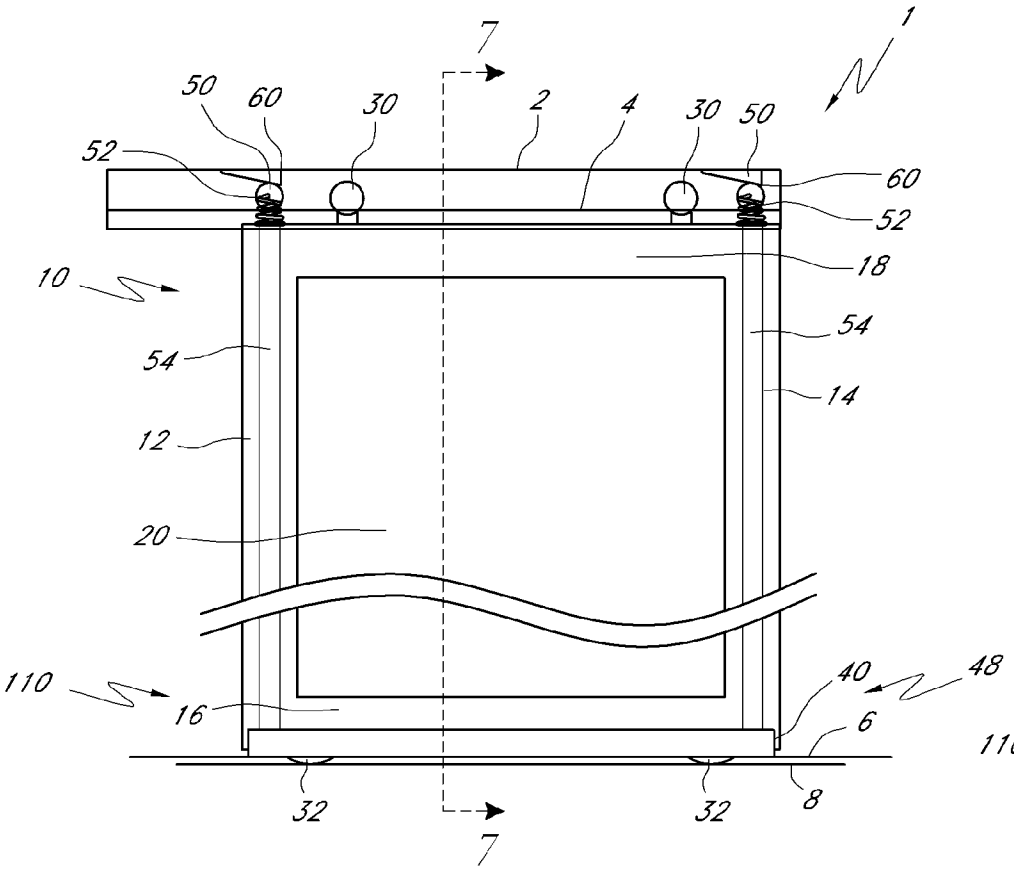
FIG. 6 is a schematic front elevation view of the door panel of FIG. 3 with the movable sealing member in an extended or closed configuration.
Figure 9:
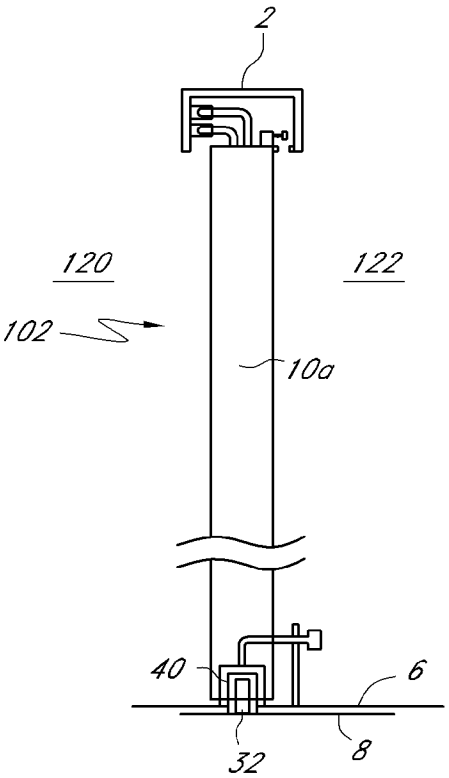
FIG. 9 is schematic side view of the door panel of FIG. 8.
Figure 8:
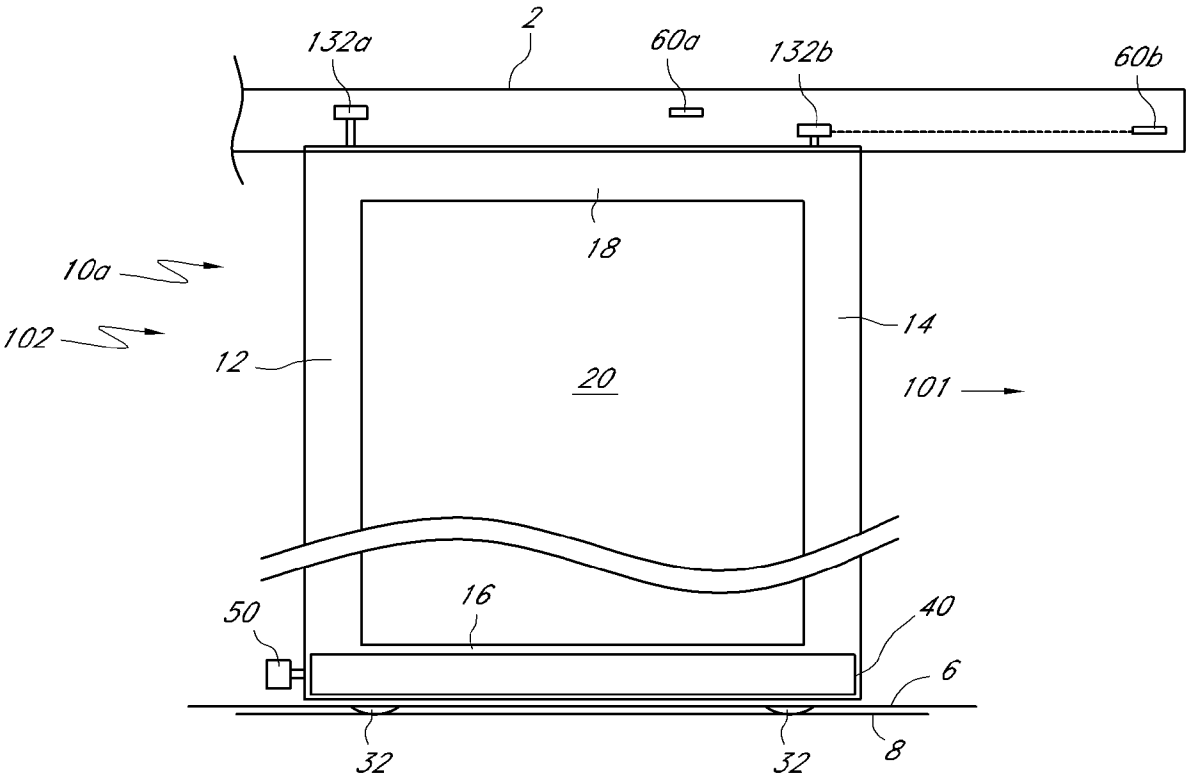
FIG. 8 is a schematic front elevational view of another embodiment of door panel having a movable sealing member in a retracted configuration.
Figure 11:
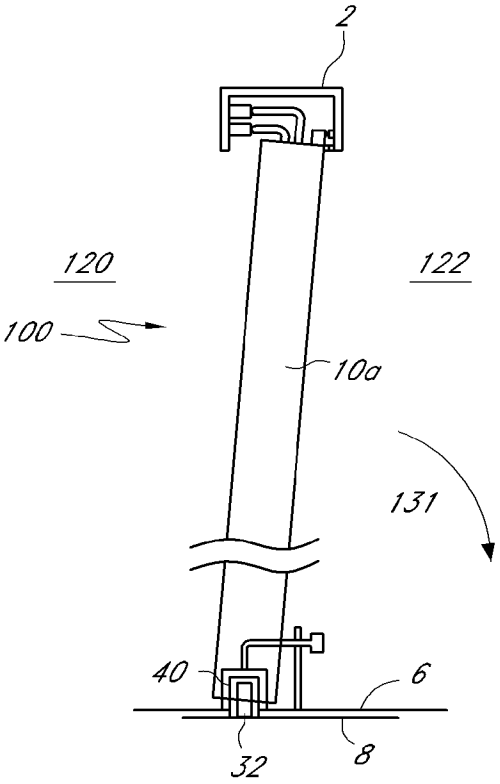
FIG. 11 is a schematic side view of the door panel of FIG. 10.
Figure 10:
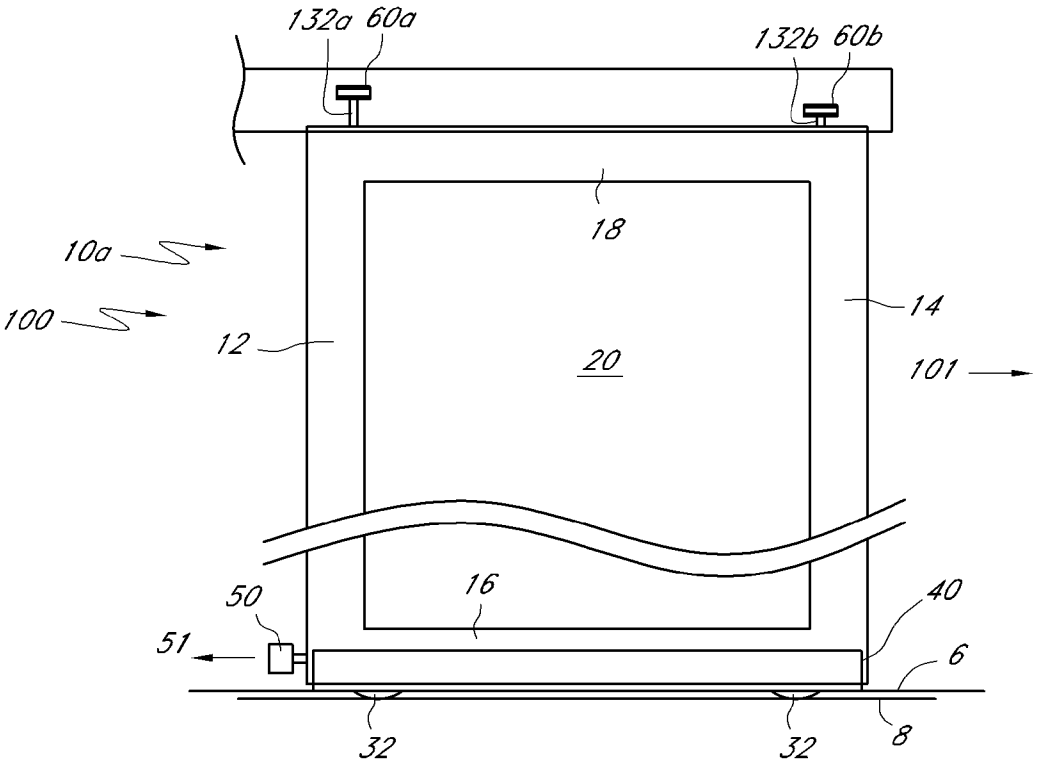
FIG. 10 is a schematic front elevation view of the door panel of FIG. 8 with the movable sealing member in a closed configuration.
Figure 12:
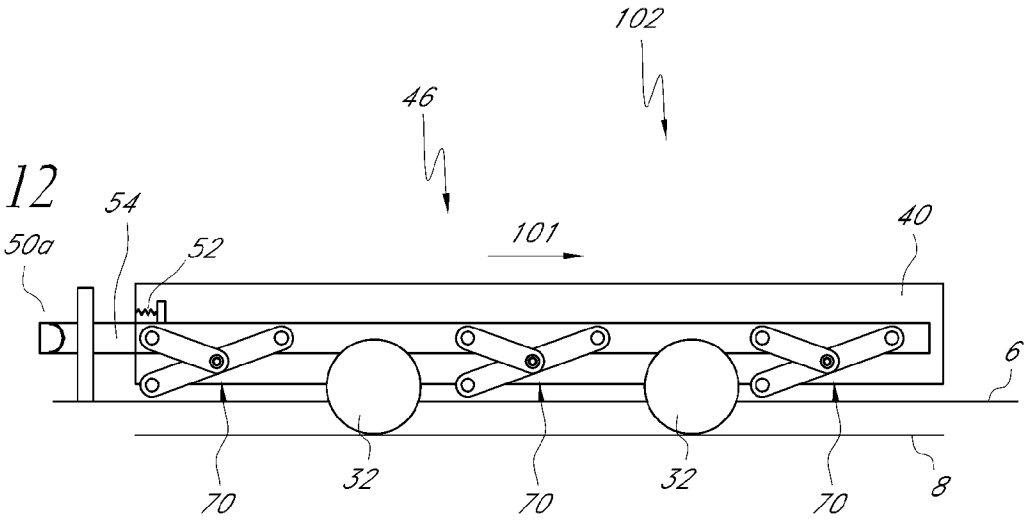
FIG. 12 is a schematic side view of an actuation mechanism in a retracted position according to one embodiment of the present invention.
Figure 13:
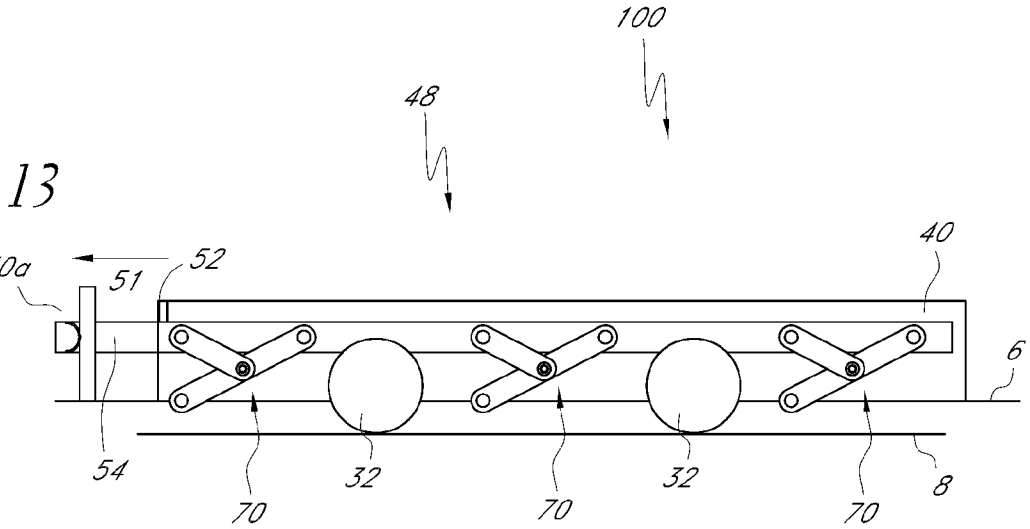
FIG. 13 is a schematic side view of the actuation mechanism of FIG. 12 in an extended position.
Figures 14, 15:
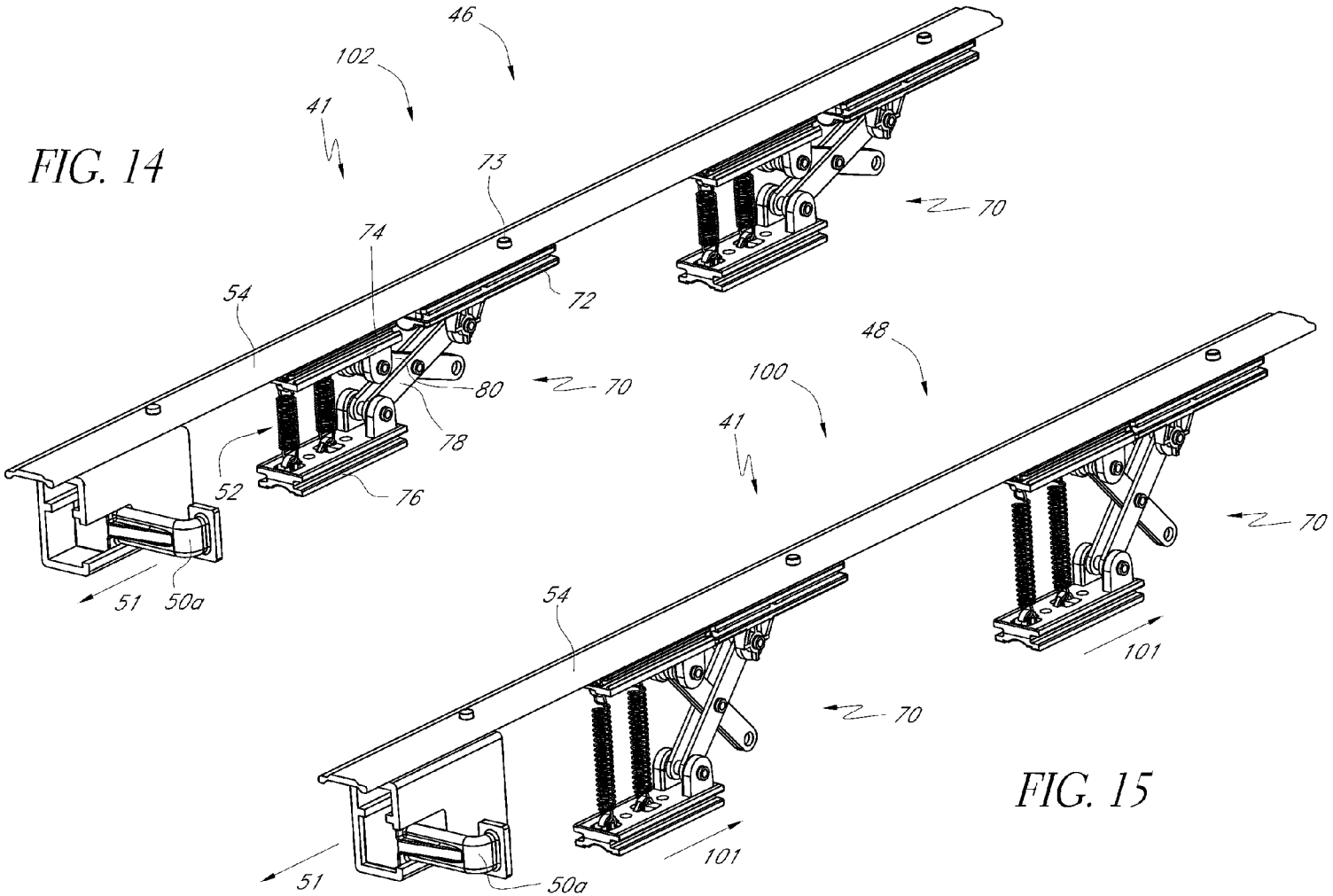
FIG. 14 is a schematic side perspective view of an actuation mechanism with a seal actuation mechanism in a retracted position according to one embodiment of the present invention.
FIG. 15 is a schematic side perspective view of the actuation mechanism with a seal actuation mechanism of FIG. 14 in an extended position.

With reference to FIG. 4, which illustrates a bottom view of one embodiment of the door panel 10, one embodiment of the sealing member 40 can include one or more seal elements 42. In one embodiment, the seal elements 42 can be a strip of weather stripping. In one embodiment, the seal element 42 is a brush. In other embodiments, the seal elements 42 can be a synthetic or natural rubber seal or gasket. In one embodiment, the seal elements 42 are flat. In one embodiment, the seal elements 42 are tapered. In one embodiment, the seal elements 42 are slanted. In one embodiment, the seal elements 42 are curved. In one embodiment, the seal elements 42 are shaped for interfacing with the door panel 10 to provide a seal. In one embodiment, the seal elements 42 are comprised of a compressible material such that by applying pressure to the seal elements 42 when they contact a floor surface 6 or a header 2 or another door panel 10 or other surface, a substantially airtight and/or watertight seal is formed. In various embodiments, the seal elements 42 can be joined to the sealing member by adhesive, fastener, press-fit into a groove formed in the sealing member 40, or other joining technique. In one embodiment, two seal elements 42 are present. It is contemplated that in other embodiments, more or fewer seal elements 42 can be used on a seal member 40.

In one embodiment, sealing member 40 can also comprise apertures 44 therethrough. In one embodiment, the apertures 44 are sized and configured to allow the passage of one or more lower roller mechanisms 32. In other embodiments, the sealing member 40 can have a width less than substantially the width of the door panel 10, and can be positioned so as not to interfere with the operation of the lower roller mechanisms 32. In one embodiment, the sealing member 40 does not have one or more apertures 44 therethrough.

In one embodiment, the sealing member 40 is coupled to an actuator 41 that moves it between a retracted position 46 and an extended, sealed position 48. In one embodiment, the retracted position 46 corresponds to a retracted configuration 112. In one embodiment, the sealed position 48 corresponds to an extended configuration 110. In various embodiments, the seal member 40 moves anywhere in the range of 1-25 mm between the retracted configuration 112 and the extended configuration 110. In various embodiments, the seal member 40 moves anywhere in the range of 5-20 mm between the retracted configuration 112 and the extended configuration 110. In various embodiments, the seal member 40 moves anywhere in the range of 10-15 mm between the retracted configuration 112 and the extended configuration 110. In one embodiment, the seal member 40 moves approximately 12 mm between the retracted configuration 112 and the extended configuration 110. In one embodiment, the actuator 41 can comprise an actuation mechanism 50, and a transfer member 54. In the illustrated embodiment at FIGS. 3-7, the actuation mechanism 50 comprises a roller mechanism configured to roll against an upper surface of the header 2. In other embodiments, the actuator 41 can comprise other mechanisms, such as, for example, a skid configured to slide along a surface of the header 2. In other embodiments, the actuator 41 can be positioned at other locations. For example, in some embodiments, the actuator 41 can be a mechanism or trigger positioned to actuate against a wall, a pocket 3, another door panel 10, the floor surface 6, or in a recess in the floor surface 6. In some embodiments, the actuation mechanism 50 can be a roller mechanism positioned to roll against the floor surface 6, or in a recess in the floor surface 6. In other embodiments, the actuator 41 can be positioned in one of the stiles 12, 14. In other embodiments, the actuator 41 can be positioned in one of the rails 16, 18.

In one embodiment, the actuation mechanism 50 can be positioned in an off-center location with respect to the width of the door panel 10. This off-centered position can prevent interference between the actuation mechanism 50 and the header 2 or the upper track 4 or the lower track 8. In some embodiments, the actuator 41 comprises more than one actuation mechanism 50 and transfer member 54, and the individual actuation mechanisms 50 can be positioned on opposite sides of a midpoint of the width of the door panel 10. This opposite side positioning can prevent interference between more than one actuation mechanism 50 or unintended actuation of one of the actuation mechanisms 50 as the door is slid.

In one embodiment, a transfer member 54 operatively couples the actuation mechanism 50 to the sealing member 40. As illustrated, the transfer member 54 is schematically represented as an elongate member or structure. It is contemplated that in some embodiments, the transfer member 54 can be a metallic or non-metallic bar or rod. In other embodiments, the transfer member 54 can be a nonmetallic bar or rod, a linkage assembly, or another coupling member. The illustrated roller mechanism is rotatably coupled to one end of the transfer member 50, while the sealing member 40 is coupled to the opposite end. Accordingly, displacement of the actuation mechanism 50 in a vertical direction can cause a corresponding displacement of the sealing member 40.

With reference to FIGS. 3 and 5, in the illustrated embodiments, the transfer members 54 extend substantially vertically through the stiles 12, 14 between the actuation mechanisms 50, and the sealing member 40. In other embodiments, the actuation members 50 may be positioned at other locations on the door panel 10, and therefore, it is contemplated that the routing of the transfer member 54 can extend at least partially horizontally or completely horizontally, such as through the lower or upper rails 16, 18 in some embodiments. In some embodiments, the transfer member 54 can extend through tunnels, channels, or other conduits in the stiles 12, 14. In another embodiment, the transfer member 54 can extend through the central area 20.

In one embodiment, the transfer members 54 are coupled to the sealing member 40 near or adjacent to its ends. In other embodiments, it can be desirable to apply pressure to the sealing member at one or more locations between its ends. Therefore, in one embodiment, it can be desirable to that the transfer member runs substantially vertically in a stile 14, 16, then horizontally in the lower rail 16 to couple to the sealing member 40 at a location between the ends where force application is desired.

In some embodiments, the actuator 41 can comprise a biasing member 52 to bias the actuator 41 into a position corresponding to a retracted configuration 112 of sealing member 40. The biasing members have been removed from FIGS. 5 and 7 for clarity. In one embodiment, the biasing member 52 tends to press the actuation mechanism 50 towards an upper surface of the header 2, thus pulling the sealing member 40 into a retracted position 46. In other embodiments, a biasing member 52 could be directly coupled to the sealing member 40 to bias it into the retracted position 46 corresponding to retracted configuration 112. In the illustrated embodiment, each actuation mechanism 50 is coupled to a biasing member 52. In other embodiments having more than one actuation mechanism 50, one, some, or all of the actuation mechanisms can be coupled to one or more biasing members 52.

With reference to FIGS. 3, 5, 6, and 7, one embodiment of the operation of the sealing system is illustrated with respect to the door panel 10. As noted above, in one embodiment, the sealing member 40 is in the retracted position 46 with respect to the door panel 10. Thus, the door panel 10 is freely slideable with respect to the upper track 4 and lower track 8 with no unwanted drag from a sliding seal and no corresponding wear on the seal. However, when the door panel 10 reaches a predetermined location with respect to the door frame 1, the actuator 41 extends the sealing member 40 such that the seal elements 42 form a seal with the floor surface 6. In one embodiment, the predetermined location corresponds to the closed configuration of the door panel system 100.

In some embodiments, a door panel system 11 can include one or more actuation surfaces 60 positioned on the header 2. In various embodiments, the actuation surface 60 can be used to assist in sealing the top, bottom, or side of the door panel 10. In one embodiment, the actuation surface 60 tilts the top of the door panel 10 to seal the top of the door panel 10. In one embodiment, the actuation surface 60 is configured to interact with the actuation mechanism 50 of the actuator 41 of the door panel 10. For example, in the illustrated embodiment of FIGS. 3-7, where the actuation mechanism 50 comprises a roller mechanism 30, the actuation surface 60 can comprise an inclined ramp or wedge surface configured to displace the roller vertically as it rolls on the ramp. In one embodiment, the ramp has a substantially constant slope. It is contemplated, however, that in other embodiments, the ramp can have a variable slope profile, such as a curve. Further, in some embodiments, the ramp can include a dip or detent to define a rest position of the door panel 10, such that the initial application of force is required to move the actuation mechanism 50 (and therefore, the associated door panel 10) from the dip or detent.

In one embodiment, once the door panel 10 has reached the predetermined location corresponding to the closed configuration 100, the actuation mechanism 50 is advanced along or up the actuation surface 60 by the continued sliding of the door panel 10. This advancement of the actuation mechanism 50 with respect to the actuation surface 60 displaces the actuation mechanism 50 vertically. In one embodiment, the actuation mechanism 50 is coupled to the sealing member 40 via the transfer member 54, therefore this vertical displacement extends the sealing member away from the lower edge of the door panel and towards the extended position. Typically, the predetermined location for actuation of the actuator 41 corresponds to the closed position of the door panel 10. Thus, when the door panel 10 is closed, the floor surface 6 under the door can be sealed. Accordingly, in one embodiment of a door panel 10 including a sealing system as described herein can be desirably used for an exterior door, where it can be advantageous to block external air, water and/or debris when the door is closed.

In various embodiments, a sealing system for a door panel 10 as described herein can be applied to a door panel 10 of a sliding door system to create a seal with substantially any substantially level flooring surface, and can advantageously provide sealing even on irregular flooring surfaces. For example, the sealing system can work with any solid track material or flooring options, such as stone, cement, aluminum, wood, Corian, glass, or other materials. Unlike other multi-slide door systems, the sealing member 40 for a door panel described herein can compensate for irregularities in the flooring surface and substantially seal the door against the elements.

In one embodiment, no large leverage-generating handle is required to facilitate the sliding operation of the door panels 10 described herein. Thus, in one embodiment, a door panel 10 having the sealing system described herein can provide sealing ability and be able to be retracted into a pocket 3. Additionally, in various embodiments, the sealing system described herein can be produced with a reduced parts count and at a lower cost as it avoids the hardware-intensive lever mechanism. Also, tracks for panels of a multi-slide door system without a large handle can be positioned closer together than corresponding tracks for a similar system having large handles. This closer track spacing advantageously allows the door systems described herein to be positioned in walls or pockets having reduced depth.

In one embodiment, a sliding door system 11 with automatically sealing door panels 10 can include rollers 30, 32 that are vertically adjustable with respect to the door frame 10. In contrast, many other multi-slide door systems lack adjustable rollers. Moreover, the adjustment of rollers in other sliding door panels 10 can be particularly problematic as a roller spacing adjustment can significantly impact door sealing performance. For example, a roller adjustment can cause a gap to form between the door and the floor surface 6, or can cause the seal to wear extremely quickly. This difficulty in roller height adjustment can be experienced often with existing sliding door systems as a building and/or door frame settles over time. In contrast, the roller height spacing of the door panels described herein is easily adjustable without a significant impact on the sealing system, which is actuated as the door panel is at a predetermined position.

In one embodiment, a sliding door system 11 with automatically sealing door panels 10 can be integrated with a motor driven opening and closing system to form an automatic, motor-driven door system. Typically, existing automatic doors have been difficult to seal as their motor-driven nature can prematurely wear seals as compared with manual operation. Also, it can be complex and costly to configure a motorized system to actuate a lever handle for each door panel of a prior art multislide system. In contrast, with a door panel 10 as described in various embodiments herein, the sealing member 40 is extended at a predetermined location (such as when the door is in a closed configuration 100) and, thus, is not dragged along the floor surface 6 by a motor drive mechanism. Moreover, the motor-driven system does not need to actuate individual handles as the sealing members 40 are deployed in response to a position of the door panel 10. Thus, the automatically sealing door panels 10 described herein can be relatively easily integrated with a motor-driven system.

In various embodiments, a door panel system 11 can include any of the embodiments of a door panel 10 described herein. In one embodiment, a door panel 10*a* includes a system for actuating a bottom sealing member 40 located in the bottom portion of the door panel 10*a*. In one embodiment, a door panel 10*a* includes a system for actuating a seal at the top of the door panel 10*a*. In one embodiment, a door panel 10*a* includes a system for sealing a side or sides of the door panels, such as with adjacent door panels 10*a*, 10*a*', etc. or sealing the side of a door panel 10*a* with a wall, pocket 3, or other structure. In various embodiments, the door panel 10*a* can be driven manually, by motor, by pressure, by gravity, or by other drive systems.

In various embodiments, the door panel 10*a* can have any of the features or structure of various embodiments of the door panel 10 described above. For example, the door panel 10*a* can be configured to be slideably moveable with respect to a header 2. In one embodiment, the header 2 can have an upper track 4. In one embodiment, the door panel 10*a* can be configured to be slideably disposed on a lower track 8. In various embodiments, the lower track 8 can be recessed below a floor surface 6, even with a floor surface 6, or raised above a floor surface 6. In some embodiments, the door panel 10*a* can include one or more lower roller mechanisms 32 configured to ride on the lower track 8. Various embodiments of the door panel 10*a*, door frame 1, header 2, upper track 4, floor surface 6, and recessed lower track 8 can have varying configurations depending on the particular door installation. In one embodiment, door panel 10*a* is configured to apply a majority of the weight of the door panel 10*a* on a lower track 8.

In various embodiments, the door panel 10 can further comprise a sealing system. In one embodiment, the sealing system comprises a sealing member 40 comprised of one or more seal elements 42, and an actuator 41. In one embodiment, the sealing member 40 is coupled to an actuator 41 that moves it between a retracted position 46 and an extended, sealed position 48. In one embodiment, the retracted position 46 corresponds to a retracted configuration 112. In one embodiment, the sealed position 48 corresponds to an extended configuration 110. In one embodiment, the actuator 41 can comprise an actuation mechanism 50, and a transfer member 54.

In one embodiment, the transfer member 54 is oriented in a generally horizontal position in or near the bottom of the door panel 10*a*. In one embodiment, the actuation mechanism 50 is moved in a direction arrow 51 to actuate. In various embodiments the actuation mechanism 50 can be located at the leading end, trailing end, or anywhere along the length of a door panel 10*a*. In various embodiments, the actuation mechanism 50 is an extendable rod or button at the leading end of the door panel 10*a* configured to actuate the actuator 41 when the door panel 10*a* impacts or abuts a surface, such as a wall, door frame 1, another door panel 10*a*, or other object. In one embodiment, the actuation mechanism 50 is located to a side, either on the interior 120 side or the exterior side 122, and consists of a trigger type mechanism configured to actuate the actuator 41 when the door panel 10*a* impacts or abuts a surface, such as a wall, door frame 1, another door panel 10*a*, or other interface. In one embodiment, the actuation mechanism 50 is located at or near the trailing edge of the door panel 10*a*, and consists of a hook type mechanism configured to actuate the actuator 41 when the door panel 10*a* impacts or abuts an interface, such as a wall, door frame 1, another door panel 10*a*, or other interface.

In the illustrated embodiment at FIGS. 12-15, the actuation mechanism 50*a* is an offset trigger surface attached to a horizontal transfer member 54. In one embodiment, the actuator 41 can comprise a biasing member 52 to bias the actuator 41 into a position corresponding to a retracted configuration 112 of sealing member 40. In one embodiment, the actuation mechanism 50*a* moves the horizontal transfer member 54 in the same direction as the movement of the actuation mechanism 50*a*. In one embodiment, the transfer member 54 is slideably disposed and moveable within or near the lower rail 16. In one embodiment, the sealing member 40 is moved between the retracted position 46 and extended position 48 with one or more seal actuation mechanisms 70. In various embodiments, one, two, three, four, five, six or more seal actuation mechanisms 70 can be used.

In various embodiments the seal actuation mechanism 70 can be any sort of mechanical, pneumatic, hydraulic, or other mechanism for actuating the seal member 40. For example, the seal actuation mechanism 70 can include gas pressure, air pressure, fluid pressure, a solenoid, a lead screw, a linkage, magnetism or other means for actuating the seal member 40. In one embodiment, the seal actuation mechanism 70 is a linkage. In one embodiment, the seal actuation mechanism 70 is a scissor mechanism. In one embodiment, the seal actuation mechanism 70 is at least a three point linkage.

In one embodiment, as illustrated at FIGS. 14-18, the seal actuation mechanism 70 comprises a transfer member interface 72, a door panel interface 74 and a seal member interface 76. In one embodiment, the transfer member interface 72, a door panel interface 74 and a seal member interface 76 cooperate in a manner similar to a scissor hinge to translate the horizontal sliding motion of a transfer member 54 to a vertical actuation of a seal member 40.

Figure 16:
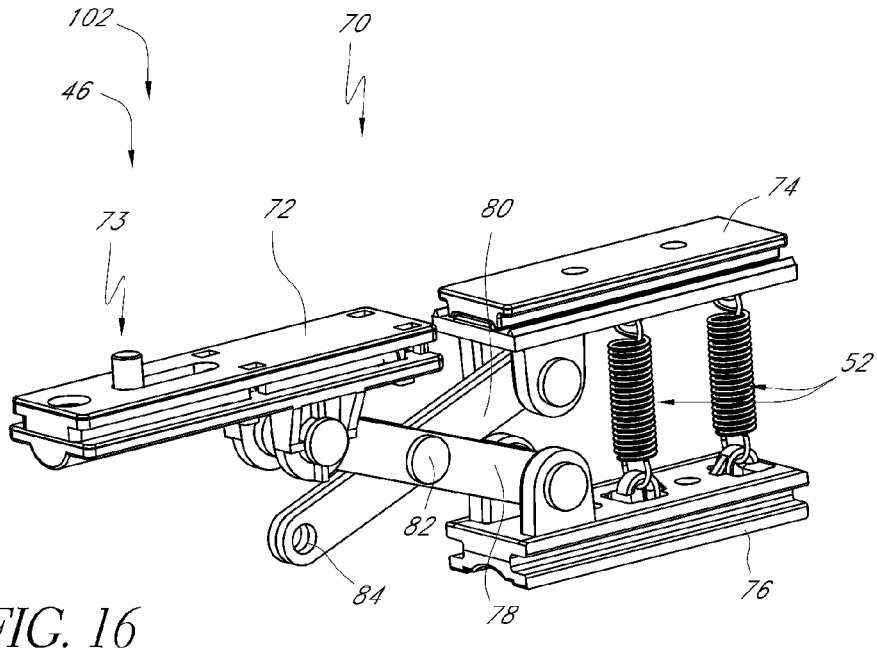
FIG. 16 is a schematic side perspective view of a seal actuation mechanism in a retracted position according to one embodiment of the present invention.
Figure 17:
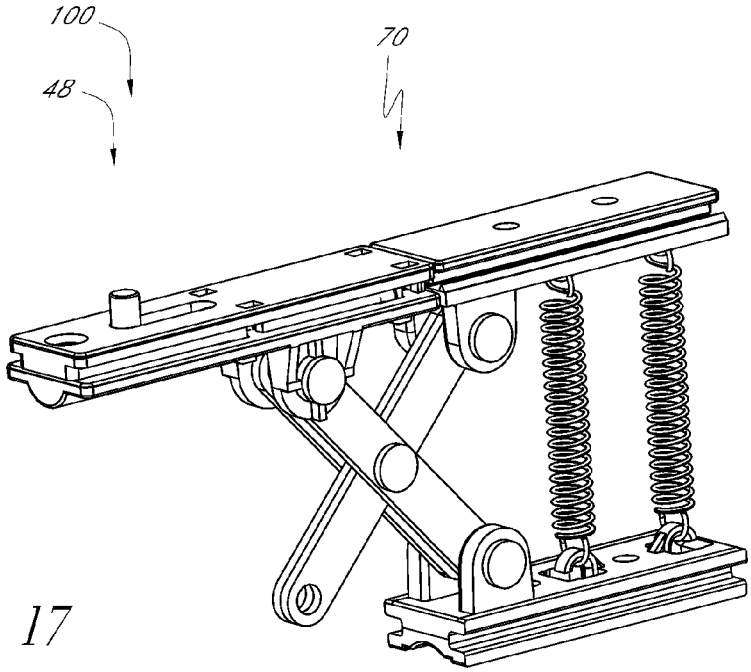
FIG. 17 is a schematic side perspective view of the seal actuation mechanism of FIG. 16 in an extended position.

In various embodiments the transfer member interface 72 is permanently or removably attachable to the transfer member 54. For example, in some embodiments the transfer member interface 72 is connected to the transfer member 54 with a pin, a screw, an interlock, a lock, a biased pin, a pin attached to a spring, or other type of attachment mechanism. In one embodiment, the door panel interface 74 is attached with a pivot hinge or pivot point to any of the rails or stiles, or other suitable portion of the door panel 10*a*. In one embodiment, the door panel interface 74 is attached with a pivot hinge or pivot point to the bottom rail 16. In one embodiment, the door seal member interface 76 is attached with a pivot hinge or pivot point to one or more a seal members 40. In one embodiment, the seal actuation mechanism 70 comprises at least a first link 78 pivotally attached to the transfer member interface 72 and the seal member interface 76. In one embodiment, the first link 78 is pivotally attached at a first link first end to the transfer member interface 72 is pivotally attached at a first link second end to the seal member interface 76. In one embodiment, the first link 78 is pivotally attached at an intermediate point 82 to a second link 80. In one embodiment, the second link 80 is pivotally attached at a second link first end to the door panel interface 74. In one optional embodiment, the second link 80 may also extend to a second link second end at the intermediate point 82. In one optional embodiment, the second link 80 may also extend to a second link second end at an extended second link second end 84. In various embodiments the optional extended second link second end 84 may be attached to nothing, or pivotally attached to a second seal member interface 76' (not illustrated here) that is slideably disposed along the seal member 40. As illustrated in FIGS. 16 and 17, in one embodiment, a seal actuation mechanism 70 is a scissor mechanism shown with an empty extended second link second end 84.

In one embodiment, the transfer member interface 72 is connected to the transfer member 54 with a biased pin 73. In one embodiment, the biased pin engages the transfer member 54 with a complimentarily shaped interface, in which the sliding motion of the transfer member 54 slideably moves the transfer member interface 72 in the same direction as the transfer member 54. In one embodiment, the biased pin 73 has a spring mechanism in it that allows over travel of the transfer member 54. This may comes into play when any of the lower roller mechanisms 32 are adjusted to different heights and the gap under the door is different in different locations. For example, in one embodiment, the floor surface 6 may be sloped or contain discontinuities. For example, in one embodiment, one side of door panel 10*a* may have a ¼" gap and the other side may have a ⅜" gap the bias or spring mechanism allows the biased pin 73 that is attached to the transfer member 54 to travel further once the ¼" gap has come into contact with the floor surface 6, allowing for an equal pressure to be applied across the sealing member 40 even though the gap to be sealed varies. In one embodiment, the transfer member 54 is mounted to an actuation mechanism 50*a* that is mounted in a door panel interlock as adjacent door panels 10*a* travel to their respective home positions at the closed configuration 100. In one embodiment, the actuation mechanism 50*a* is a trigger that is pulled, thus forcing the sealing member 40 to seal to the floor surface 6.

In one embodiment, the door panel interface 74 and a seal member interface 76 have one or more biasing members 52 attached between them. In one embodiment, the biasing member 52 is a spring. In one embodiment, the biasing member 52 helps retract the seal actuation mechanism 70 forcing the sealing member 40 into a retracted position 46, thus allowing the seal to ride free of the floor surface 6 or a threshold when the door panel 10*a* is not in its home, closed configuration 100.

In one embodiment, a door panel 10*a* is configured to seal the top of the door at the closed configuration 100. In one embodiment, the door panel 10*a* seals the top of the door at the closed configuration 100 with a door tilting system 130. In one embodiment, the door tilting system 130 is configured to tilt the door in a tilt direction 131 that is roughly normal, or perpendicular to the upper track 4 and/or the lower track 8. In one embodiment, a door panel 10*a* is configured to slide from side to side, with the door tilting system 130 configured to tilt the door panel 10*a* toward the interior 120, exterior 122, or both. In one embodiment, as illustrated at FIGS. 18-19, the door tilting system 130 is configured to tilt the door panel 10*a* toward the exterior 122 in order to effectuate a seal to keep exterior 122 elements, such as wind, air, water, or other materials, from entering the various tracks or door mechanisms.

In one embodiment, the door tilting system 130 comprises one or more actuation surfaces 60 positioned on the header 2. In one embodiment, the actuation surface 60 tilts the door panel 10*a* at the closed configuration 100 to seal the top of the door. In one embodiment, the actuation surface 60 interfaces with a corresponding door tilting interface 132 attached to the door panel 10*a* to seal the top of the door. In various embodiments, the actuation surfaces 60 can be vertical ramps, horizontal ramps, bumper, wedges, guides, blocks, or other shapes to tilt the door panel 10*a* when it arrives at a closed configuration 100. In various embodiments, the door tilting system 130 can comprise one, two, three, four, five, six or more actuation surfaces 60 configured to correspond to a closed position 100 of a door panel 10*a*. In various embodiments, the door tilting system 130 can comprise one, two, three, four, five, six or more door tilting interface 132 configured to correspond to a closed position 100 of a door panel 10*a*.

Figure 18:
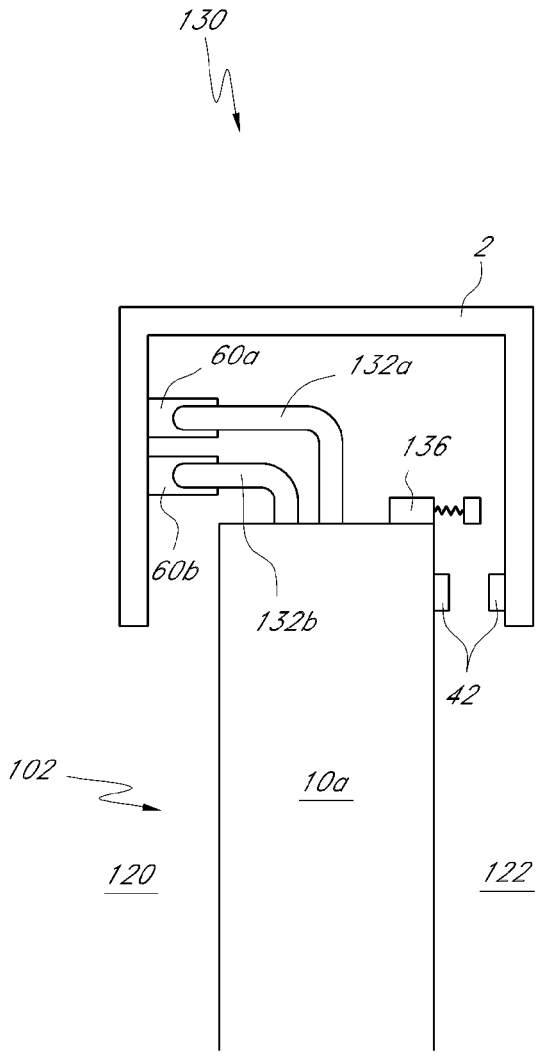
FIG. 18 is a schematic side view of a door tilting system in an open configuration according to one embodiment of the present invention.
Figure 19:
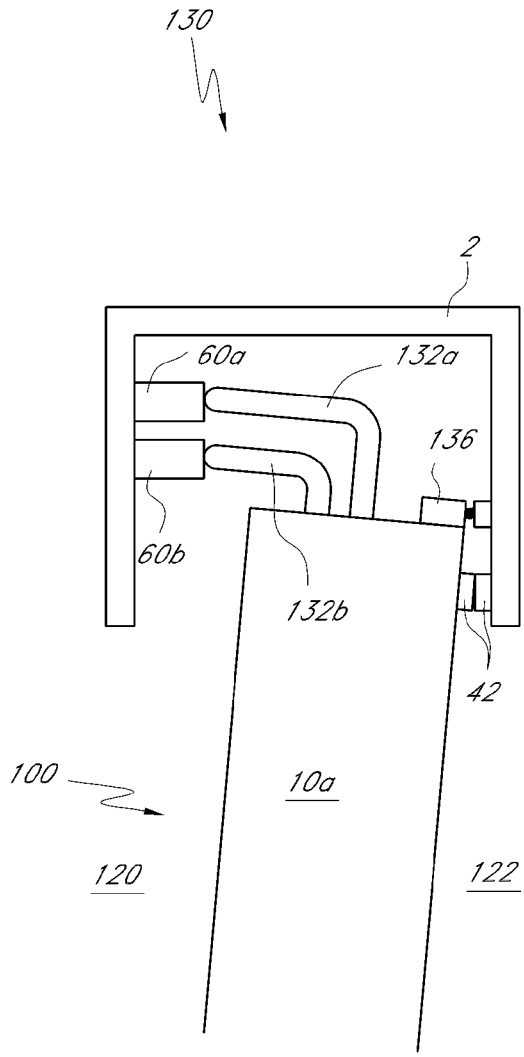
FIG. 19 is a schematic side view of the door tilting system of FIG. 18 in an open configuration.
Figure 20:
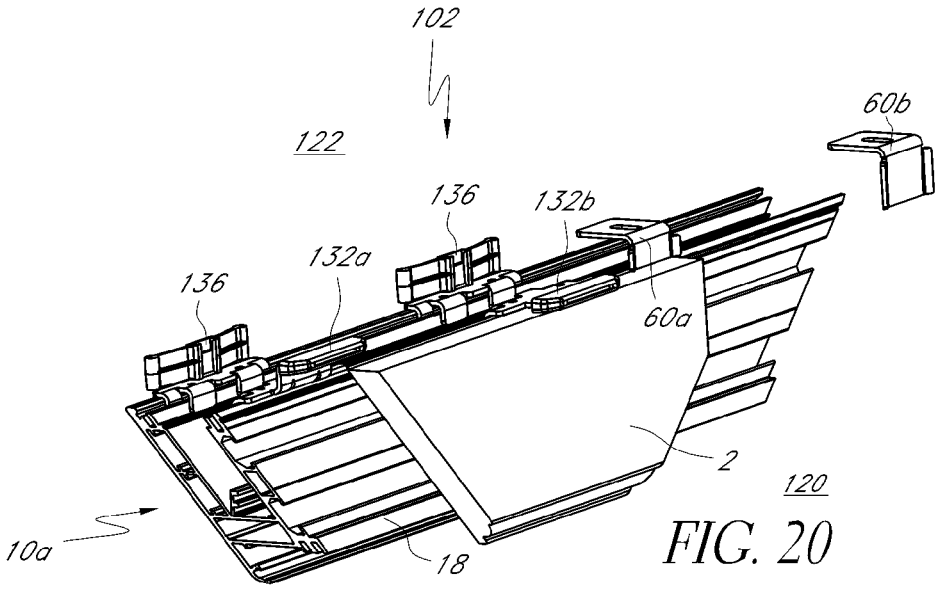
FIGS. 20-23 are schematic side perspective partial views of a door panel with a door tilting system in an open configuration according to an embodiment of the present invention.
Figure 21:
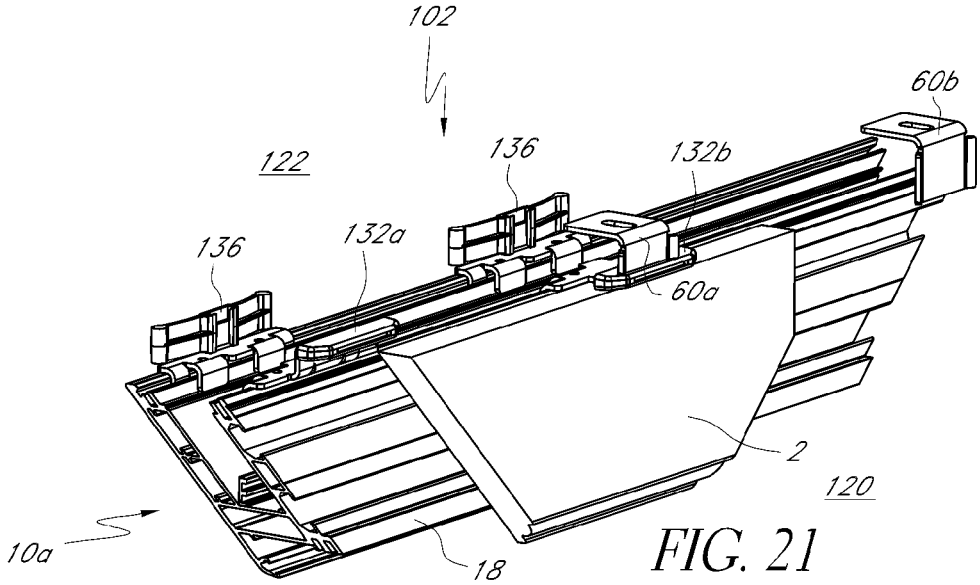
Figure 22:
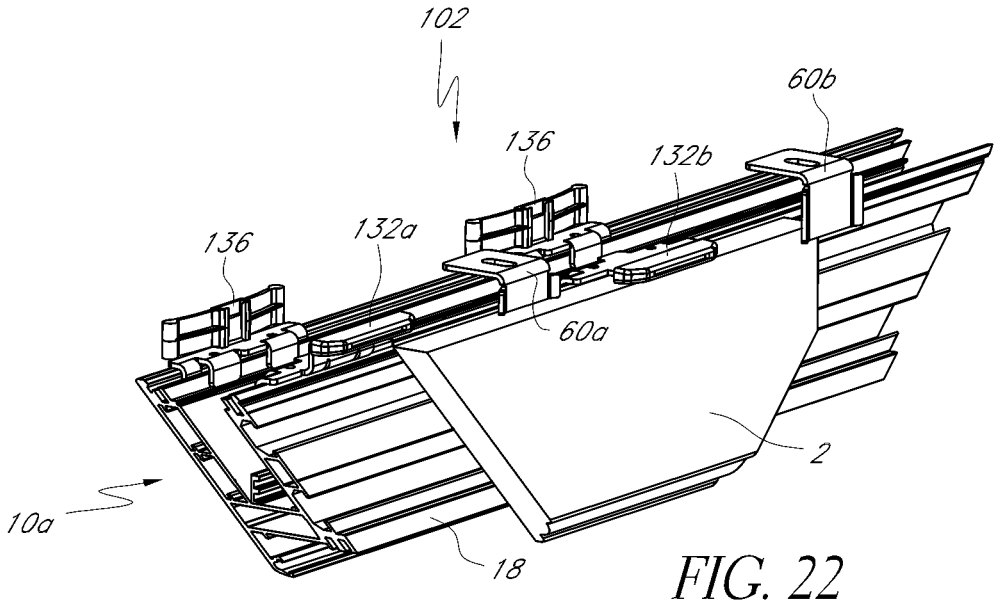
Figure 23:
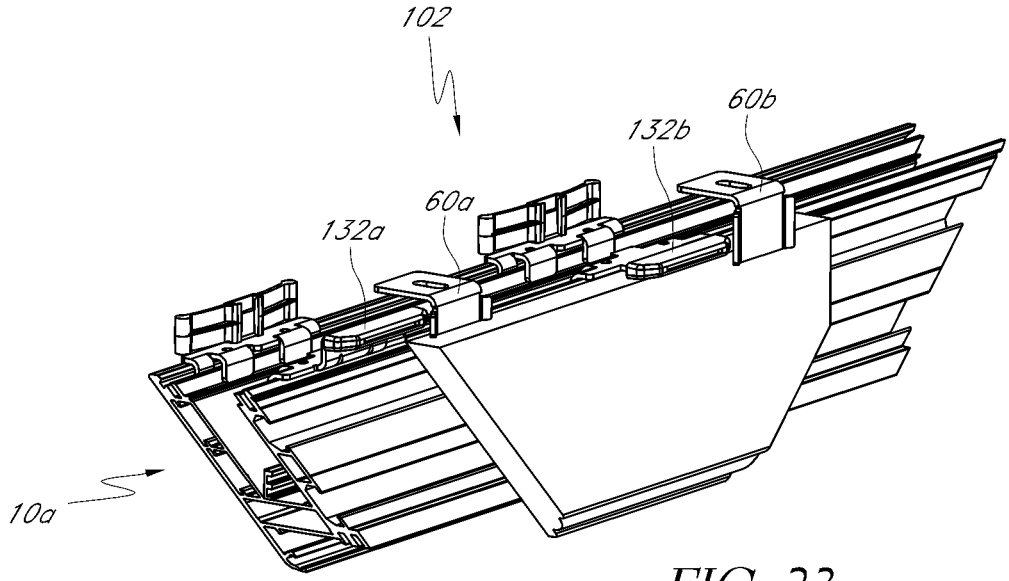
Figure 24:
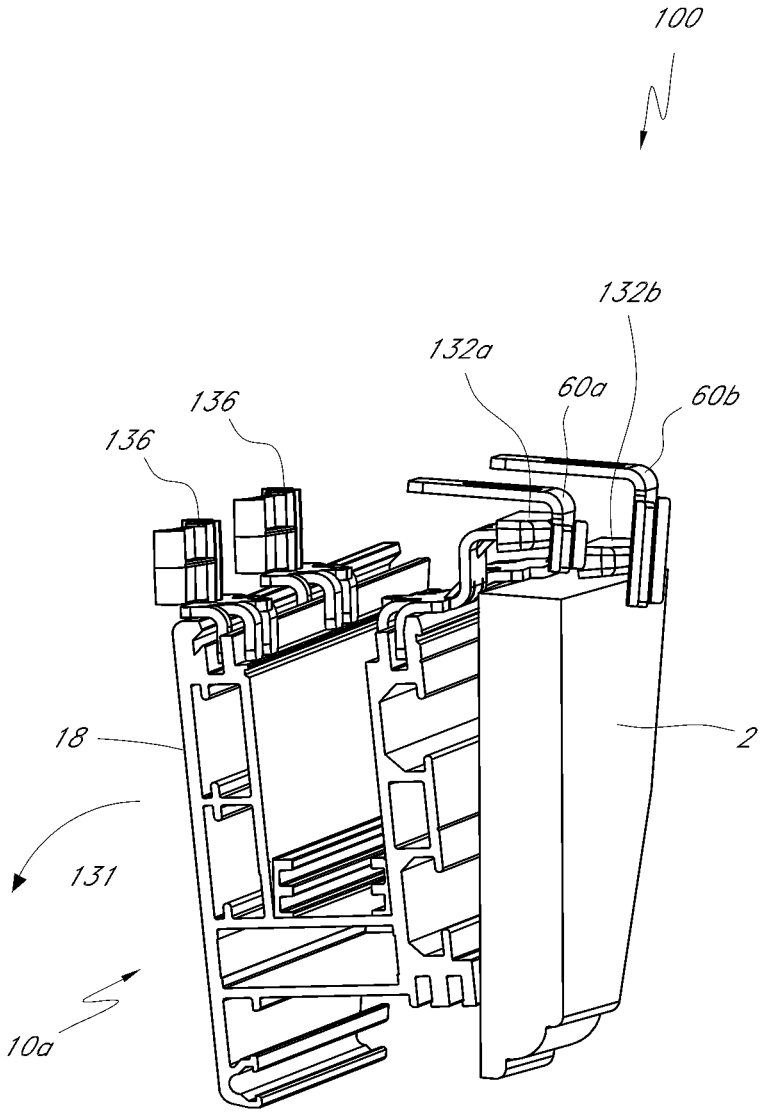
FIG. 24 is a schematic side perspective partial views of the door panel with a door tilting system of FIGS. 20-23 in a closed configuration.

In one embodiment, illustrated at FIGS. 18 and 19, two actuation surfaces 60 and two corresponding door tilting interfaces 132 illustrate a door tilting system 130. In one embodiment, the actuation surfaces 60 include two offset wedges, a proximal or trailing wedge 60*a* and a distal or leading wedge 60*b*. In one embodiment, the door tilting interfaces 132 include two offset door tilting interfaces, a proximal or trailing door tilting interface 132*a* and a distal or leading door tilting interface 132*b*. The offset wedges and door tilting interfaces are configured to allow the leading door tilting interface 132*b* to slide toward the closed configuration 100 in a direction 101 without interference from the trailing wedge 60*a*. In one embodiment, the trailing wedge 60*a* and the trailing door tilting interface 132*a* are taller or set higher than the leading wedge 60*b* and the leading door tilting interface 132*b*. Numerous other embodiments can use varying combinations of interfaces with any number of actuation surfaces 60 and/or door tilting interfaces 132. FIGS. 20-24 illustrate a series of positions between the open configuration 102 and a closed configuration 100 of an embodiment of a door panel 10*a* and a header 2 with actuation surfaces 60*a*, 60*b* and tilting interfaces 132*a*, 132*b*. FIG. 20 illustrates a door panel 10*a* in an open position 102, with a distal door tilting interface 132*a* proximal a leading wedge 60*b*. FIGS. 21-23 illustrate the relative movement of the door panel 10*a* in a direction 101 toward the closed position 100, with offset wedges and door tilting interfaces passing each other until the corresponding pairs of wedges and door tilting interfaces meet at the closed position 100 in FIG. 24.

In one embodiment, the actuation surfaces 60 and/or door tilting interfaces 132 compress a seal, such as a seal element 42 at or near the top of the door. In one embodiment, the seal element 42 is static weather stripping mounted onto the header 2 or top track 4. In various embodiments, the seal element 42 can be attached to the door panel 10*a* alone, the header 2 alone, or both the door panel 10*a* and the header 2. In one embodiment, once the door panel 10*a* comes to the home position at the closed configuration 100, the force imparted between the interference or contact between the one or more actuation surfaces 60 and corresponding door tilting interfaces 132 tilts the door panel 10*a* and compresses the top rail of the door into the seal element 42.

In one embodiment, the door tilting system 130 comprises a guide 136. In one embodiment, the guide 136 is located on the opposite side of the actuation surface 60. In one embodiment, the guide is a deflectable, biased guide configured to help the door panel 10*a* slide while reducing rattling or bouncing by taking up space between the top of the door panel 10*a* and the header 2 when the door panel system 11 is in an open configuration 102. In one embodiment, the guide 136 is a plastic spring. In one embodiment, the guide 136 can provide a smooth, low friction gliding surface interface between the door panel 10*a* and the header 2 or upper track 4. In one embodiment, once the door panel 10*a* comes to the home position at the closed configuration 100, the contact between the one or more actuation surfaces 60 and corresponding door tilting interfaces 132 tilts the door panel 10*a* in a tilt direction 131 and compresses, deflects, or deforms the guide 136. In one embodiment, when the door panel 10*a* is in an open configuration, the guide 136 expands, deflects, or reforms back to a shape to assist in rattle reduction and assist in sliding of the door panel 10*a*.

In various embodiments, a door panel system 11 can comprise one or more door panels 10, 10*a* configured to seal along one or more sides of a door panel 10, 10*a*. In various embodiments, the sides of the door panels 10, 10*a* can be configured to overlap, seal, include an interface, a seal element 42, or other means to reduce fluid communication between the interior 120 and exterior 122 along the sides of the door panels 10, 10*a*.

In one embodiment, a door panel system 11 comprising more than one door panel 10, 10*a* can be extended from pocket 3 or other starting open configuration 102 and moved to a closed configuration 100 by moving the lead door panel 10, 10*a* and moving it toward the closed configuration 100 in a direction 101. Subsequent adjacent door panels 10, 10*a* can be pulled along like a train or series of doors on the same or parallel, or roughly parallel tracks 4, 8 through manual or motor driven actuation of the lead door panel 10, 10*a*.

It will be understood by those of skill in the art that numerous and various modifications can be made without departing from the spirit of the present invention. For example, although several of the embodiments described herein discuss linear movement of door panels along tracks that can be parallel or linear, it is also contemplated that door panels, track, and related movement can be accomplished with rounded doors and or tracks, curves and/or arcs, or other shapes as well. Therefore, it should be clearly understood that the forms of the present invention are illustrative only and are not intended to limit the scope of the present invention. Although a few embodiments have been described in detail above, other modifications are possible. Other embodiments may be within the scope of the following claims. It will be understood that the foregoing is only illustrative of the principles of the invention, and that various modifications, alterations, and combinations can be made by those skilled in the art without departing from the scope and spirit of the invention. Accordingly, it is not intended that the invention be limited, except as by the appended claims.

What is claimed is:

1. A sealable sliding door system comprising:

a header comprising at least one tilt actuation surface;

a lower track parallel to the header; and a door panel slideably moveable along the lower track and the header, the door panel comprising:

a panel surface bounded by a first side edge, a second side edge, an upper edge and a lower edge; and an upper sealing edge comprising at least one door tilting interface configured to interact with the at least one tilt actuation surface, which tilts the door panel in a direction normal to the panel surface to reduce an upper distance between the upper edge of the door panel surface and the header when the door panel reaches a predetermined location corresponding to a sealed configuration.

2. The sealable sliding door system of claim 1, further comprising:

a lower sealing member movably actuatable with respect to a lower sealing edge of the door panel between a refracted position and a sealed position, the retracted position configured for slideable movement of the door panel along the lower track, the sealed position closing a lower distance between the lower sealing edge of the door panel and a floor surface.

3. The sealable sliding door system of claim 2, further comprising:

an actuator configured to advance the lower sealing member into the sealed position when the door panel reaches the predetermined location corresponding to the closed configuration.

4. The sealable sliding door system of claim 2, wherein the lower sealing edge corresponds to the lower edge of the door panel and wherein angular movement of the door panel with respect to the lower track defines a tilting axis of the door panel.

5. The sealable sliding door system of claim 2, wherein linear movement of the door panel with respect to the lower track defines a sliding axis of the door panel, wherein the door panel has a length along the sliding axis, and wherein the lower sealing member has a length that is substantially equal to the length of the door panel.

6. The sealable sliding door system of claim 3, wherein the lower sealing member is connected to one or more seal actuation mechanisms comprising at least a three point linkage.

7. The sealable sliding door system of claim 3, wherein the lower sealing member is connected to one or more seal actuation mechanisms comprising a scissor mechanism.

8. The sealable sliding door system of claim 1, further comprising a seal element disposed between the upper edge of the door panel and the header.

9. The sealable sliding door system of claim 1, further comprising a second upper sealing edge corresponding to the upper edge of the door panel, the second upper sealing edge configured to reduce a second upper distance between the upper edge of the door panel and the header when the door panel reaches a second predetermined location corresponding to a second closed configuration.

10. The sealable sliding door system of claim 9, further comprising a second actuation surface and a second door tilting interface configured to tilt the door panel when the door panel reaches the second predetermined location corresponding to the second closed configuration, wherein movement of the door panel in a tilt direction reduces the second upper distance.

11. The sealable sliding door system of claim 2, wherein the door panel further comprises a biasing member configured to bias the lower sealing member into the retracted position.

12. The sealable sliding door system of claim 1, further comprising a second door panel slideably moveable along a second lower track and the header.

13. The sealable sliding door system of claim 1, wherein the actuator comprises an actuation mechanism with a substantially horizontal transfer member slideably disposed and linearly moveable within or near the lower edge of the door panel, wherein the actuation mechanism is configured to automatically actuate upon contact with an actuation surface.

14. The sealable sliding door system of claim 1, wherein the sealed configuration reduces any one of the group of air communication, gas communication, liquid communication, water communication, and fluid communication through the sealable sliding door system.

15. The sealable sliding door system of claim 1, wherein the door panel comprises a window.

16. A tiltable sealing door panel comprising:

a first door stile;

a second door stile opposite the first door stile;

an upper rail;

a lower rail;

a central area bounded by the first door stile, the second door stile, the upper rail, and the lower rail;

an upper tilting mechanism configured to seal the door panel to a header of a door frame, wherein the upper tilting mechanism comprises a door tilting interface on the upper rail and a tilt actuation surface on the header configured to tilt the central area about the lower rail to reduce an upper distance between the upper edge of the door panel and the header when the door panel reaches a predetermined location corresponding to a sealed configuration.

17. The tiltable sealing door panel of claim 16, further comprising a lower sealing mechanism comprising:

a lower sealing member positioned on the lower rail and movable between a first position in which the lower sealing member is extended downward with respect to the lower rail, and a second position in which the lower sealing member is retracted with respect to the lower rail; and an actuator configured to move the lower sealing member between the first position and the second position, wherein the actuator comprises an actuation mechanism and a sliding transfer member coupling the actuation mechanism to the lower sealing member.

18. The tiltable sealing door panel of claim 17, wherein the actuation mechanism comprises a roller mechanism configured to roll on an actuation surface on the door frame.

19. The tiltable sealing door panel of claim 18, wherein the roller mechanism is rotatably mounted to the upper rail and configured to roll on an actuation surface on the header of the door frame.

20. The tiltable sealing door panel of claim 18, wherein the actuator comprises:

a first roller mechanism mounted to the upper rail and configured to roll on an actuation surface on the header of the door frame;

a second roller mechanism mounted to the upper rail and configured to roll on an actuation surface on the header of the door frame;

a first transfer member extending through the first door stile and coupling the first roller mechanism to the sealing member; and a second transfer member extending through the second door stile and coupling the second roller mechanism to the sealing member.

* * * * *

UNITED STATES PATENT AND TRADEMARK OFFICE

CERTIFICATE OF CORRECTION

PATENT NO. : 8,631,606 B2
APPLICATION NO. : 13/772176
DATED : January 21, 2014
INVENTOR(S) : Hans It is certified that error appears in the above-identified patent and that said Letters Patent is hereby corrected as shown below:

In the Claims

Column 16 at line 48, Claim 2, change "refracted" to --retracted--.

Signed and Sealed this
Sixteenth Day of September, 2014

Michelle K. Lee

Michelle K. Lee
*Deputy Director of the United States Patent and Trademark Office*